US008567419B2

(12) United States Patent
Pei

(10) Patent No.: US 8,567,419 B2
(45) Date of Patent: Oct. 29, 2013

(54) EVAPORATION MATERIAL CLEANING APPARATUS

(75) Inventor: Shao-Kai Pei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 817 days.

(21) Appl. No.: 12/778,148

(22) Filed: May 12, 2010

(65) Prior Publication Data

US 2010/0288314 A1 Nov. 18, 2010

(30) Foreign Application Priority Data

May 18, 2009 (CN) ..... 2009 1 0302392

(51) Int. Cl.
*B08B 3/00* (2006.01)

(52) U.S. Cl.
USPC ..... 134/95.2; 134/94.1; 134/95.1; 134/104.1; 134/143; 134/166 R; 604/82; 604/236; 604/191; 401/247; 401/213; 401/202

(58) Field of Classification Search
USPC ..... 134/95.1, 96.1, 97.1, 98.1, 99.1, 94.1, 134/104.1, 143, 152, 155, 166 R, 186, 184, 134/198; 604/82, 236, 694, 191; 34/335; 220/DIG. 6, 729; 401/247, 213, 202
See application file for complete search history.

(56) References Cited

U.S. PATENT DOCUMENTS

| | | | | |
|---|---|---|---|---|
| 4,657,616 | A * | 4/1987 | Benzing et al. | 156/345.43 |
| 5,213,117 | A * | 5/1993 | Yamamoto | 134/58 R |
| 7,186,371 | B1 * | 3/2007 | Watling | 422/3 |
| 2006/0137722 | A1 * | 6/2006 | Sollich | 134/34 |
| 2009/0151754 | A1 * | 6/2009 | Zhu et al. | 134/26 |

* cited by examiner

*Primary Examiner* — Eric Golightly
*Assistant Examiner* — Thomas Bucci
(74) *Attorney, Agent, or Firm* — Altis & Wispro Law Group, Inc.

(57) ABSTRACT

An apparatus capable of cleaning a material includes pipes arranged in a first barrel; and through holes defined in a second barrel. The second barrel is received in the first barrel. The apparatus further includes a driver comprising a drive shaft, the drive shaft extending through the first barrel and being connected to the second barrel. A fluid container is included store fluid, an air controller is provided air-dry the material. Before washing the material, the second barrel is driven by the driver to cause each of the through holes to disengage from a corresponding pipe. After washing the material, the second barrel is driven by the driver to cause each of the through holes to engage with the corresponding pipe.

7 Claims, 3 Drawing Sheets

EVAPORATION MATERIAL CLEANING APPARATUS

BACKGROUND

1. Technical Field

The present disclosure relates to apparatuses and, particularly, to an apparatus capable of cleaning a source material to be used in a physical deposition process.

2. Description of Related Art

The Electron Beam Evaporation (also know as e-beam evaporation) process falls into a larger category of Micro-Electro-Mechanical Systems (MEMS) processes. In the evaporation process, a block of the material (source) to be deposited is heated to the point where it starts to boil and evaporate. Then it is allowed to condense on the substrate that you want to coat. This process takes place inside a vacuum chamber, enabling the molecules to evaporate freely in the chamber, where they then condense on all surfaces. For e-beam evaporation, an electron beam is used to heat the source material and cause evaporation. In preparing for the process of electron beam evaporation, some contaminants may get on the source material, which can be transferred to the surface of the substrate during deposition.

Therefore, an apparatus that can remove contaminants from the surface of a source material is desired to overcome the above-described deficiencies.

BRIEF DESCRIPTION OF THE DRAWINGS

The components in the drawings are not necessarily drawn to scale, the emphasis instead being placed upon clearly illustrating the principles of an apparatus capable of washing and drying source material. Moreover, in the drawings, like reference numerals designate corresponding parts throughout the several views.

DETAILED DESCRIPTION

Figure 1:
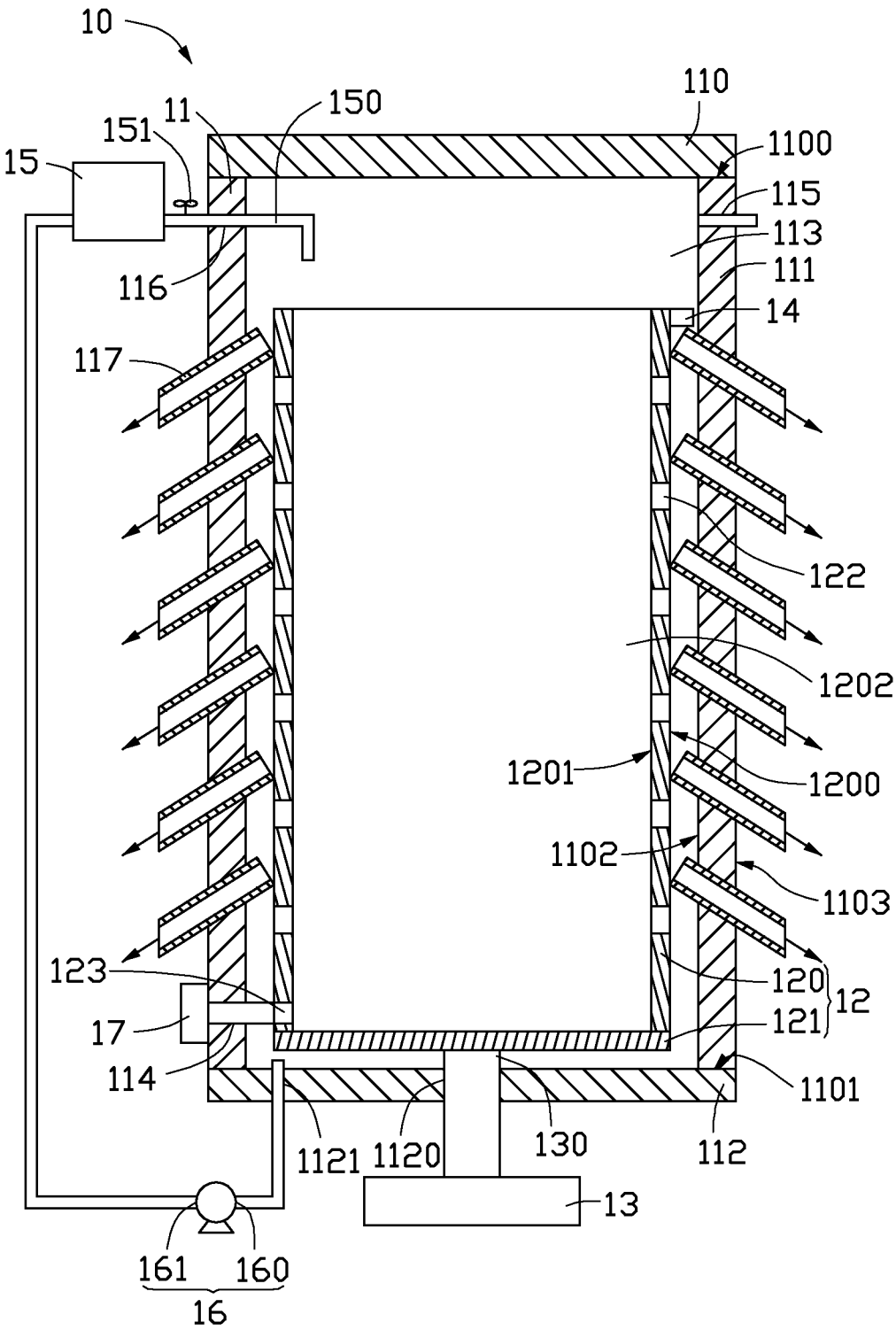
FIG. 1 is a schematic view of an apparatus capable of washing and drying source material in accordance with an exemplary embodiment.

Referring to FIG. 1, an apparatus 10 capable of washing and drying a source material is illustrated. The apparatus 10 includes a first barrel 11, a second barrel 12, a driver 13, an ultrasonic oscillator 14, a fluid container 15, a pump 16, and an air controller 17.

The first barrel 11 includes a top plate 110, a first hollow barrel body 111, and a first bottom plate 112. The top plate 110 and the first bottom plate 112 are attached to the two ends of the barrel body 111. The top plate 110, the first hollow barrel body 111, and the bottom plate 112 form a first receiving space 113 for receiving the second barrel 12. The first hollow barrel body 111 includes a first top surface 1100, a first bottom surface 1101, a first inner sidewall 1102, and a first outer sidewall 1103. The first top surface 1100 is secured to the top plate 110, and the first bottom surface 1101 is secured to the bottom plate 112.

The first barrel 11 further includes at least one first air inlet 114, at least one air outlet 115, at least one fluid inlet 116, and at least one fluid cycle outlet 1121, in this embodiment there are one of each. The first air inlet 114 is defined in the hollow barrel body 111 adjacent to first bottom surface 1101. The air outlet 115 and the fluid inlet 116 are also defined in the first hollow barrel body 111 but adjacent to the first top surface 1100. The fluid cycle outlet 1121 is defined in the first bottom plate 112. The first bottom plate 112 also defines a through hole 1120. In the embodiment, the through hole 1120 is arranged in the center of the bottom plate 112.

A plurality of pipes 117 is arranged in the first hollow barrel body 111. Each of the pipes 117 extends through the first hollow barrel body 111. One end of each of the pipes 117 extending into the first barrel 11 is closer to the top plate 110 of the first barrel 11 than an opposite end of each of the pipes 117 extending out of the first barrel 11. In the embodiment, the pipes 117 are spaced apart from each other and are parallel to each other.

The second barrel 12 includes a second barrel body 120 and a second bottom plate 121. The second barrel body 120 is perpendicularly secured to the second bottom plate 121. The second hollow barrel body 120 and the second bottom plate 121 form a second receiving space 1202 for receiving source material and fluid. The second barrel body 120 includes a second outer sidewall 1200 and a second inner sidewall 1201. The second outer sidewall 1200 resists the end of each of the pipes 117 extending into the first barrel 11. A plurality of through holes 122 are defined in the second barrel body 120. Each of the through holes 122 corresponds to one pipe 117. After the source material is washed, the second barrel 12 is driven to move upwards to cause each of the through holes 122 to engage with the corresponding pipe 117, thus the fluid and any contaminants washed from the material can flow out of the second barrel 12 via the through holes 122 and the pipes 117. During washing of the material, a certain quantity of the fluid may flow out of the second barrel 12 via the through holes 122. The second hollow barrel body 120 defines at least one second air inlet 123 adjacent to the second bottom plate 121. To dry the material after washing, the second barrel 12 is driven to move downwards to cause the second air inlet 123 to align with the first air inlet 114, thus the air controller 17 can control air to enter the second barrel 12. In the embodiment, the fluid is water.

The driver 13 is connected to the second barrel 12. The driver 13 includes a drive shaft 130. The drive shaft 130 extends through the through hole 1120 of the first barrel 11 and is connected to the second bottom plate 121. After the material is washed, the driver 13 drives the second barrel 12 to move upwards a preset distance with respect to the first barrel 11 to cause each of the through holes 122 to engage with the corresponding pipe 117. To dry the material, the driver 13 drives the second barrel 12 to move downwards a preset distance with respect to the first barrel 11 to cause the second air inlet 123 to align with the first air inlet 114.

The ultrasonic oscillator 14 is mounted on the second outer sidewall 1200 of the second barrel 12. The ultrasonic oscillator 14 is used to generate high frequency vibration for accelerating the speed of washing by agitating the fluid and by vibrating contaminants of the material loose.

The fluid container 15 is used to store fluid. In the embodiment, the fluid container 15 is adjacent to the first top surface 1100. The fluid container 15 includes an input pipe 150. The input pipe 150 extends through the fluid inlet 116 and is disposed above the second barrel 12, thus the fluid in the fluid container 15 can flow into the second barrel 12. The input pipe 150 includes a valve 151. The valve 151 is used to control the flow of the fluid from the fluid container 15.

The pump 16 includes an input port 160 and an output port 161. The input port 160 is connected to the fluid cycle outlet 1121 of the first bottom plate 112 via a pipe (not labeled). The output port 161 is connected to the fluid container 15 via a pipe (not labeled). The fluid in the first barrel 11 can flow into the fluid container 15 via the pump 16. Therefore, the fluid flowing out from the first barrel 11 during washing of the material can be recycled to wash the material again.

The air controller 17 is used to provide air to dry the material. In the embodiment, the air controller 17 is further connected to a temperature controller (not shown). The temperature controller is configured to increase the temperature of the air, thus accelerating the speed of drying the material.

Figure 2:
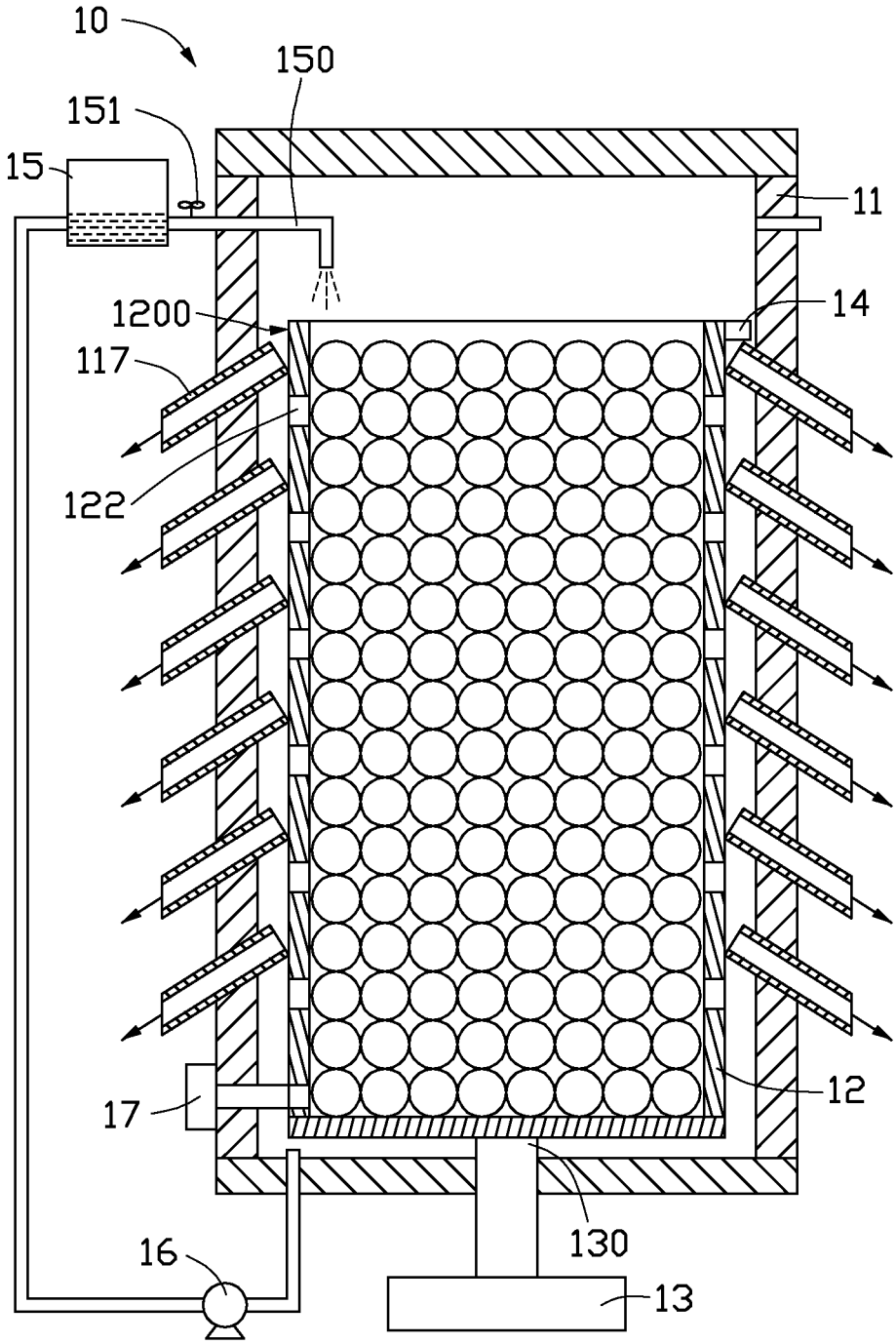
FIG. 2 is a schematic view of the apparatus of FIG. 1, showing the apparatus in a washing state.

Referring also to FIG. 2, before washing the material, the second barrel is driven by the driver 13 to cause each of the through holes 122 to disengage from the corresponding pipe 117. The material is then put into the second barrel 12. In the embodiment, the material is globoid silicon dioxide. The valve 151 of the input pipe 150, the ultrasonic oscillator 14, and the pump 16 are all turned on. The fluid in the fluid container 15 flows into the second barrel 12 via the input pipe 150. The ultrasonic oscillator 14 generates the high frequency vibration to accelerate the speed of washing the material. The fluid flowing into the first barrel 11 via the through holes 122 flows into the fluid container 15 again via the pump 16.

Figure 3:
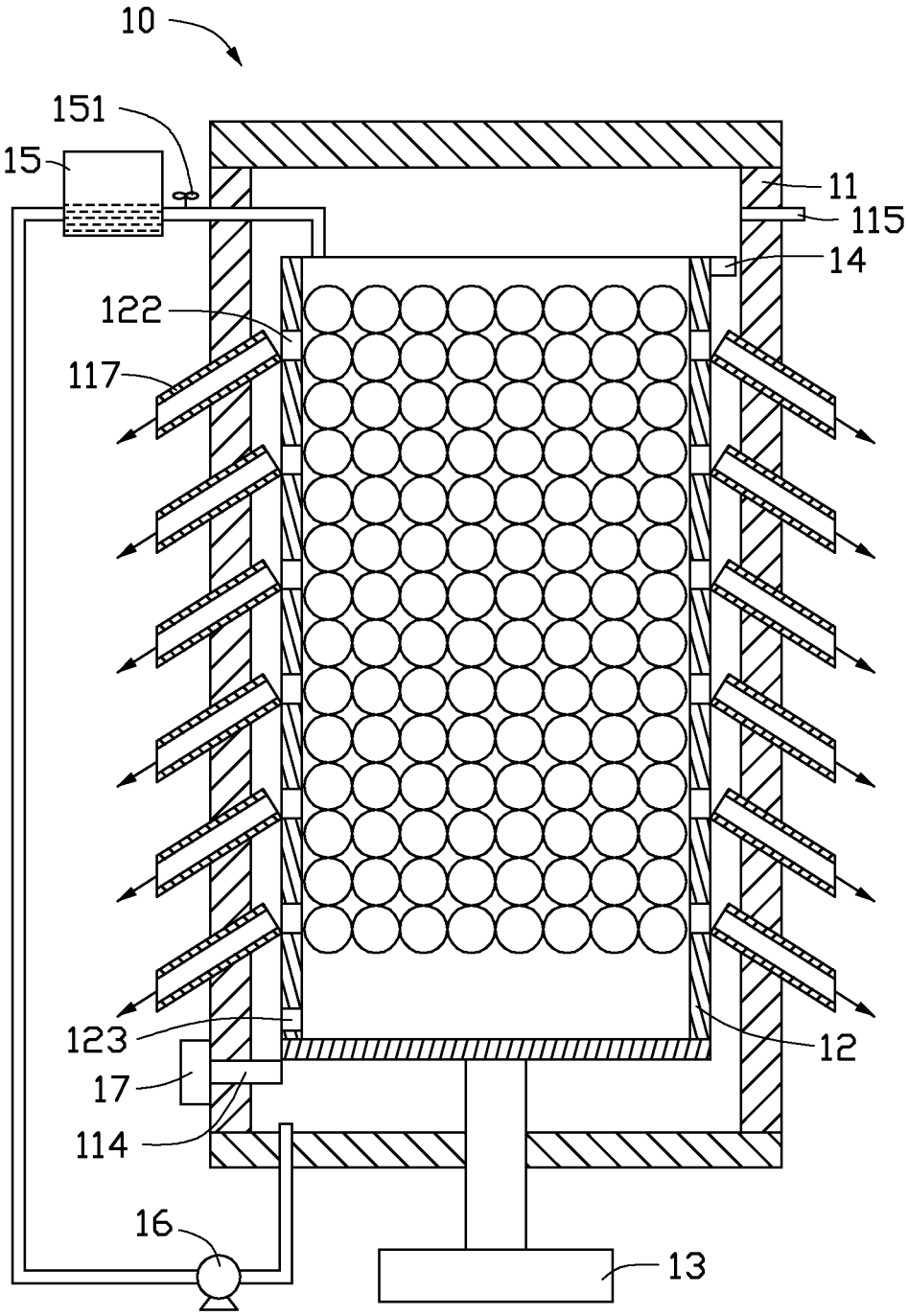
FIG. 3 is a schematic view of the apparatus of FIG. 1, showing the apparatus in a drying state.

Referring also to FIG. 3, after washing the material, the valve 151 and the ultrasonic oscillator 14 are turned off. The driver 13 drives the second barrel 12 to move upwards to cause each of the through holes 122 to engage with the corresponding pipe 117. Therefore, the fluid and contaminants can flow out of the second barrel 12 via the through holes 122 and the pipes 117. After the fluid and the contaminants have flowed out of the second barrel 12, the driver 13 drives the second barrel 12 to move downwards to cause the first air inlet 114 to align with the second air inlet 123. After that, the air controller 17 is turned on, and air enters into the second barrel 12 via the first air inlet 114 and the second air inlet 123 and exits the second barrel 12 and the first barrel 11 via the air outlet 115. The material can thus be dried.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An evaporation material cleaning apparatus, comprising:

a first barrel defining a plurality of pipes therein;

a second barrel received in the first barrel and defining a plurality of through holes, the plurality of holes operable to engage with the plurality of pipes;

a driver comprising a drive shaft, the drive shaft extending through the first barrel and being connected to the second barrel;

a fluid container to store fluid; and an air controller to provide air to dry the material;

wherein before washing the material, the second barrel is driven by the driver to cause the plurality of through holes to disengage from the plurality of pipes, after the material is washed, the second barrel is driven by the driver to cause the plurality of through holes to engage with the plurality of pipes.

2. The apparatus as described in claim 1, wherein the apparatus further comprises a pump, the first barrel comprising at least one first air inlet, at least one air outlet, at least one liquid inlet and at least one liquid cycle outlet, the fluid container comprises an input pipe; the second barrel comprises at least one second air inlet, the input pipe extends through the fluid inlet and is disposed above the second barrel, the pump is connected to the fluid cycle outlet via a pipe and is connected to the fluid container via a pipe, to dry the material, the second barrel is driven to cause the second air inlet align with the first air inlet.

3. The apparatus as described in claim 1, wherein the first barrel comprises a top plate, a first hollow barrel body, a first bottom plate; the top plate, the first hollow barrel body, and the bottom plate form a first receiving space for receiving the second barrel; the second barrel comprises a second hollow barrel body, a second bottom plate; the second hollow barrel body and the bottom plate form a second receiving space for receiving material and fluid.

4. The apparatus as described in claim 3, wherein the plurality of pipes is arranged in the first hollow barrel body, the plurality of through holes is arranged in the second hollow barrel body.

5. The apparatus as described in claim 4, wherein the pipes are spaced apart from each other and are parallel to each other.

6. The apparatus as described in claim 1, wherein the apparatus is further connected to a temperature controller, the temperature controller is used to increase the temperature of the air, thus accelerating the speed of drying the material.

7. The apparatus as described in claim 1, further comprising a ultrasonic oscillator, wherein the ultrasonic oscillator is used to generate high frequency vibration for accelerating the speed of washing the material.

* * * * *